US011540044B2

(12) United States Patent
Xiao et al.

(10) Patent No.: US 11,540,044 B2
(45) Date of Patent: Dec. 27, 2022

(54) SPEAKER DEVICE

(71) Applicant: AAC Microtech (Changzhou) Co., Ltd., Changzhou (CN)

(72) Inventors: Bo Xiao, Shenzhen (CN); Chenliang Kong, Shenzhen (CN); Tong Zhang, Shenzhen (CN); Ronglin Linghu, Shenzhen (CN); Wei Song, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/553,665

(22) Filed: Dec. 16, 2021

(65) Prior Publication Data

US 2022/0210545 A1 Jun. 30, 2022

(30) Foreign Application Priority Data

Dec. 25, 2020 (CN) ..... 202023202816.2

(51) Int. Cl.

| | |
|---|---|
| ***H04R 1/28*** | (2006.01) |
| ***H04R 1/02*** | (2006.01) |
| ***H04R 9/02*** | (2006.01) |

(52) U.S. Cl.

CPC ..... *H04R 1/2873* (2013.01); *H04R 1/021* (2013.01); *H04R 9/027* (2013.01); *H04R 2400/07* (2013.01); *H04R 2400/11* (2013.01); *H04R 2499/11* (2013.01)

(58) Field of Classification Search

CPC ..... H04R 1/023; H04R 9/025

See application file for complete search history.

(56) References Cited

U.S. PATENT DOCUMENTS

2020/0351592 A1* 11/2020 Zhao ..... H04R 1/2811
2020/0413201 A1* 12/2020 Zhao ..... H04R 1/021

* cited by examiner

*Primary Examiner* — Mark Fischer
(74) *Attorney, Agent, or Firm* — W&G Law Group

(57) ABSTRACT

A speaker device includes a frame, a vibration unit fixedly connected to the frame, a magnetic circuit unit having a magnetic gap, and a screen cloth. The vibration unit includes a diaphragm and a voice coil. The magnetic circuit unit includes a carrier, a first main magnet, an auxiliary magnet and a magnetic conductive plate. The magnetic conductive plate is fixed to the frame. The magnetic conductive plate includes a first central portion and a first edge portion; the auxiliary magnet is located at the first central portion. The first edge portion is provided with a through hole. The screen cloth is provided at a side of the carrier away from the diaphragm, and includes a second central portion and a second edge portion. The second edge portion is provided with a first groove recessed toward the magnetic conductive plate, corresponding to the through hole.

10 Claims, 7 Drawing Sheets

SPEAKER DEVICE

TECHNICAL FIELD

The present disclosure relates to the technical field of electro-acoustic conversion, and in particular, to a speaker device.

BACKGROUND

With the advent of the mobile Internet era, electronic products are increasingly updated, and the requirements for various functions of electronic products, such as a high-quality audio playback function, are getting increasingly high. In order to achieve the high-quality audio playback function, high-quality speaker devices are required.

In the related art, a speaker device is provided with a housing having an irregular outer shape and a screen cloth in a horizontal direction. The space for filling a sound absorbing material in the speaker device is insufficient, resulting in poor acoustic performance of the speaker device.

Therefore, it is necessary to provide a speaker device to solve the above technical problem.

SUMMARY

An objective of the present disclosure is to provide a speaker device with a large powder filling volume and a better acoustic effect.

The present disclosure adopts the following technical solutions.

An aspect of the present disclosure provides a speaker device. The speaker device includes: a frame, a vibration unit fixedly connected to the frame, a magnetic circuit unit having a magnetic gap, and a screen cloth. The vibration unit includes a diaphragm fixed to the frame, and a voice coil inserted in the magnetic gap. The magnetic circuit unit includes a carrier, a first main magnet provided at a side of the carrier toward the diaphragm, an auxiliary magnet provided on a periphery of the first main magnet and defining the magnetic gap with the first main magnet, and a magnetic conductive plate provided at a side of the auxiliary magnet toward the diaphragm. The magnetic conductive plate is fixed to the frame. The magnetic conductive plate includes a first central portion and a first edge portion that abuts to an edge of the first central portion; the auxiliary magnet is located at the first central portion. The first edge portion is provided with a through hole. The screen cloth is provided at a side of the carrier away from the diaphragm, and includes a second central portion and a second edge portion that abuts to an edge of the second central portion. The second edge portion is arranged opposite to the first edge portion along a vibrating direction of the diaphragm. The second edge portion is provided with a first groove recessed toward the magnetic conductive plate, corresponding to the through hole.

As an improvement, the first groove is formed by enclosing a side wall and a bottom wall; the side wall is at least partially located in the through hole, and the bottom wall is located in the through hole; and the bottom wall is flush with a surface of the magnetic conductive plate toward the diaphragm.

As an improvement, the second central portion is provided with a second groove opening toward the diaphragm; and the second groove is configured to accommodate the carrier, the first main magnet and the auxiliary magnet.

As an improvement, the first central portion includes two first edges opposite to each other, and two third edges connected to two ends of each of the two first edges respectively; and the first edge portion is connected to the first edge; and the vibration unit further includes a voice diaphragm; the voice diaphragm abuts to the two third edges; and the voice diaphragm protrudes toward the screen cloth.

As an improvement, the second central portion includes two second edges opposite to each other, and two fourth edges that are connected to two ends of each of the two second edges, respectively; and the second edge portion is connected to the second edge; and the screen cloth further includes a fourth edge portion connected to the fourth edge; the fourth edge portion is provided with a third groove opening toward the diaphragm; and the third groove is configured to avoid the voice diaphragm.

As an improvement, the diaphragm includes a first diaphragm and a second diaphragm, each of the first diaphragm and the second diaphragm has a ring shape; an outer edge of the first diaphragm is fixed to the frame; an inner edge of the first diaphragm is connected to an outer edge of the second diaphragm; the first diaphragm protrudes toward the screen cloth; and the second diaphragm protrudes facing away from the screen cloth.

As an improvement, the magnetic circuit unit further includes a second main magnet and a pole plate; the second main magnet and the first main magnet are stacked along the vibrating direction of the diaphragm; and the pole plate is provided between the first main magnet and the second main magnet; and the speaker device further includes a cover; the cover covers the second main magnet; and an inner edge of the second diaphragm is connected to an edge of the cover.

As an improvement, the diaphragm further includes a dome; and the dome is connected between the inner edge of the first diaphragm and the outer edge of the second diaphragm.

As an improvement, the diaphragm further includes a holder; the holder is provided at a side of the first diaphragm and the second diaphragm toward the voice coil; each of the first diaphragm, the second diaphragm and the dome is provided on the holder; and the voice coil is inserted in the magnetic gap through the holder.

As an improvement, the screen cloth may be a mesh cloth.

The present disclosure has the following beneficial effects. The magnets are located at the first central portion of the magnetic conductive plate. The first edge portions of the magnetic conductive plate each are provided with a through hole. The first edge portions of the magnetic conductive plate are opposite to the second edge portions of the screen cloth. The second edge portions of the screen cloth each are provided with a first groove recessed toward the magnetic conductive plate, corresponding to the through hole. The first groove can be used to fill a sound absorbing material. In this way, the space for filling the sound absorbing material in the speaker device and an equivalent volume of a rear chamber of the speaker device is increased, thereby improving the acoustic effect of the speaker device.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF EMBODIMENTS

The technical solutions of the present disclosure are clearly and completely described below with reference to the drawings in the present disclosure. Apparently, the described embodiments are merely a part, rather than all of the embodiments of the present disclosure. All other embodiments obtained by those skilled in the art based on the embodiments in the present disclosure without creative efforts should fall within the protection scope of the present disclosure.

Figure 1:
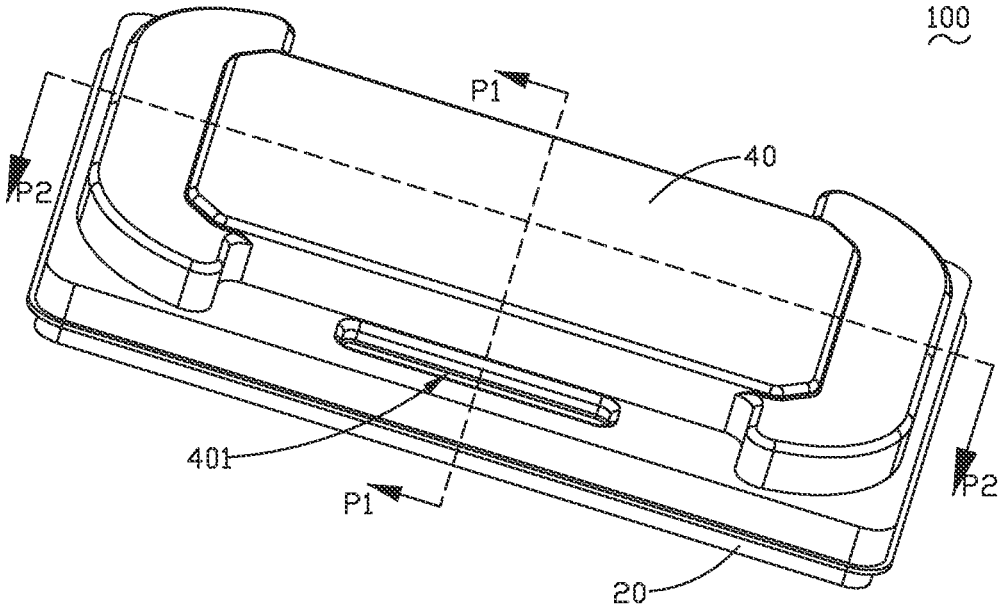
FIG. 1 is a schematic diagram illustrating a structure of a speaker device according to an embodiment of the present disclosure.
Figure 2:
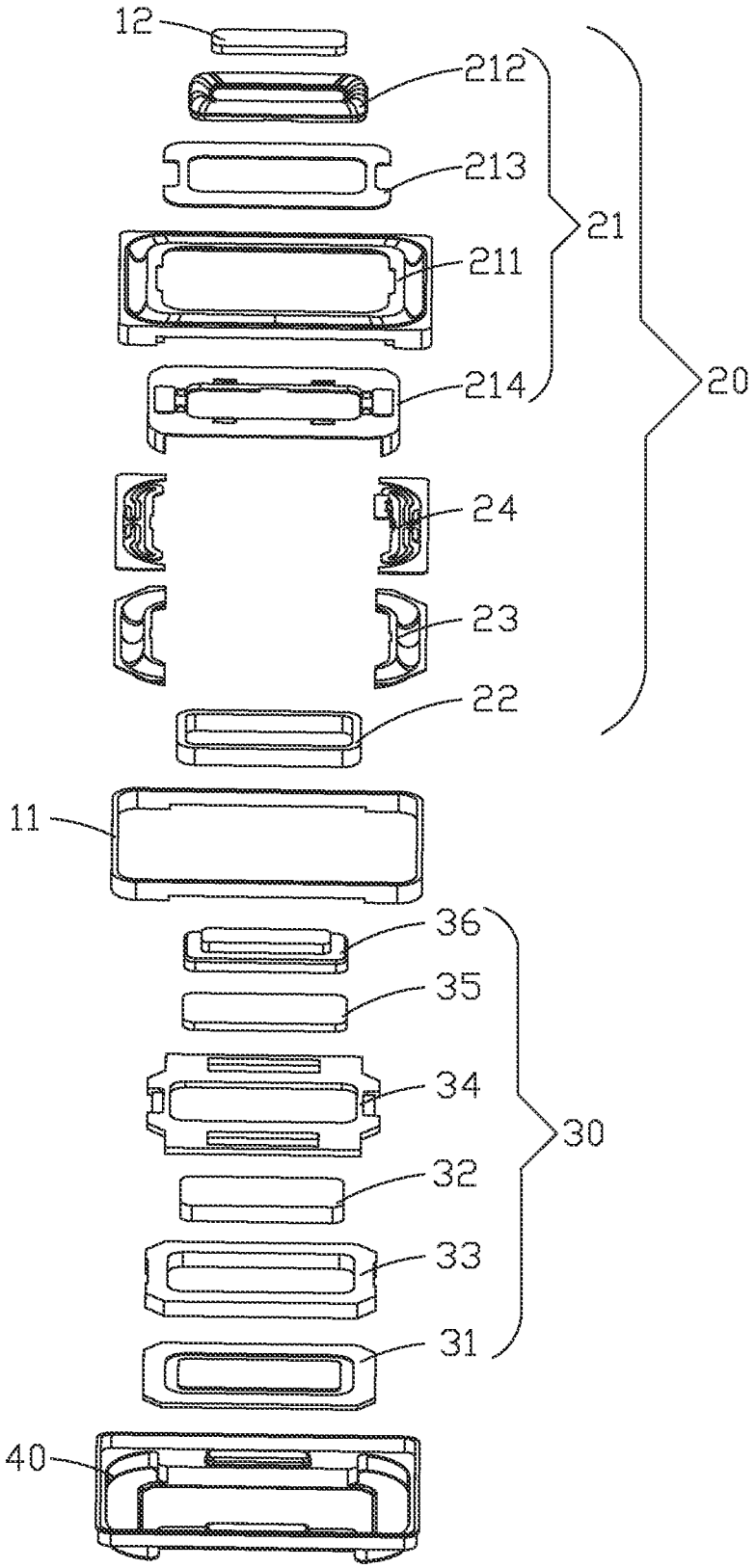
FIG. 2 is an exploded view of the speaker device shown in FIG. 1 according to an embodiment of the present disclosure.
Figure 3:
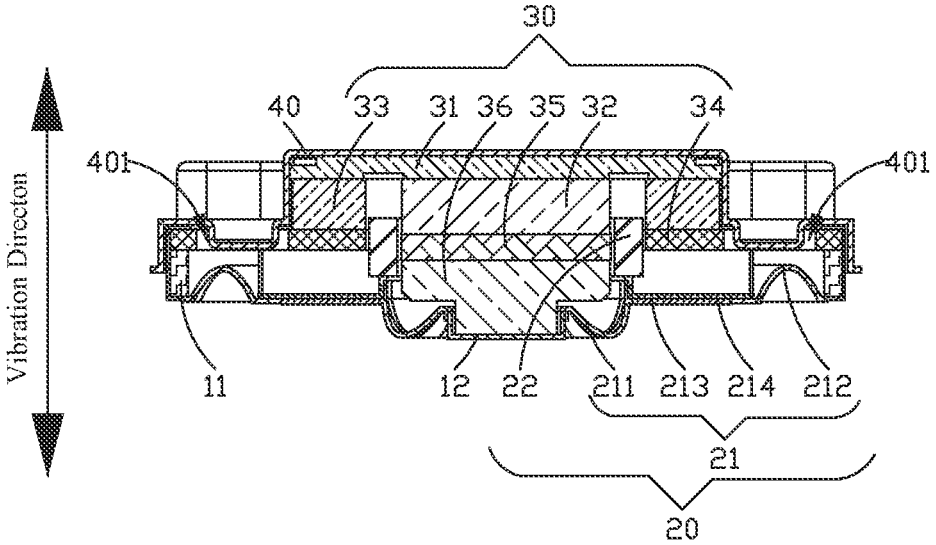
FIG. 3 is a cross-sectional view of the speaker device shown in FIG. 1 taken along line P1-P1 according to an embodiment of the present disclosure.

Referring to FIG. 1, FIG. 2 and FIG. 3, FIG. 1 is a schematic diagram illustrating a structure of a speaker device according to an embodiment of the present disclosure; FIG. 2 is an exploded view of the speaker device shown in FIG. 1 according to an embodiment of the present disclosure; and FIG. 3 is a cross-sectional view of the speaker device shown in FIG. 1 taken along line P1-P1 according to an embodiment of the present disclosure. A speaker device 100 includes a frame 11, a vibration unit 20 fixedly connected to the frame 11, and a magnetic circuit unit 30. The magnetic circuit unit 30 has a magnetic gap.

The vibration unit 20 may include a diaphragm 21 and a voice coil 22. The diaphragm 21 is fixed to the frame 11, and the voice coil 22 is inserted in the magnetic gap of the magnetic circuit unit 30. When the speaker device 100 is energized, the voice coil 22 is vibrated under the action of the magnetic circuit unit 30, which causes the diaphragm 21 to vibrate, so that the speaker device 100 emits sound.

The magnetic circuit unit 30 may include a carrier 31, a first main magnet 32, an auxiliary magnet 33 and a magnetic conductive plate 34. The magnetic conductive plate 34 is fixed to the frame 11, and the magnetic conductive plate 34 is provided on the auxiliary magnet 33. The auxiliary magnet 33 is provided on a periphery of the first main magnet 32, and there is a magnetic gap between the auxiliary magnet 33 and the first main magnet 32. The auxiliary magnet 33 is provided on the carrier 31. The first main magnet 32 is provided at a side of the carrier 31 toward the diaphragm 21. In general, the carrier 31, the first main magnet 32/the auxiliary magnet 33 and the magnetic conductive plate 34 are stacked along a vibrating direction of the diaphragm 21. The carrier 31 is far away from the diaphragm 21. The magnetic conductive plate 34 is close to the diaphragm 21.

The magnetic conductive plate 34 includes a first central portion 341 and a first edge portion 342. The first edge portion 342 abuts to an edge of the first central portion 341. The first central portion 341 and the auxiliary magnet 33 are arranged opposite to each other along the vibrating direction of the diaphragm 21. The auxiliary magnet 33 is located at a side of the first central portion 341 facing away from the diaphragm 21.

The speaker device 100 may further include a screen cloth 40, and the screen cloth 40 may be a mesh cloth. The screen cloth 40 is provided at a side of the carrier 31 facing away from the diaphragm 21. The screen cloth 40 includes a second central portion 41 and a second edge portion 42. The second edge portion 42 abuts to the edge of the second central portion 41. The second edge portion 42 is provided with a first groove 401. The first groove 401 is recessed toward the magnetic conductive plate 34 so that an opening of the first groove 401 faces away from the diaphragm 21. When the speaker device 100 is mounted in a speaker box, the first groove 401 can be used to fill a sound absorbing material, so that the space for filling the sound absorbing material in the speaker device 100 is increased, which has an equivalent volume of a rear chamber of the speaker device 100, thereby improving the acoustic effect of the speaker device 100.

The second edge portion 42 and the first edge portion 342 are arranged opposite to each other along the vibrating direction of the diaphragm 21. The first edge portion 342 is provided with a through hole 340 adapted to the first groove 401. The through hole 340 is used to avoid the first groove 401. In an embodiment, the through hole 340 and the first groove 401 are arranged opposite to each other along the vibrating direction of the diaphragm 21. A side wall of the first groove 401 is at least partially located in the through hole 340. It should be noted that a bottom wall of the first groove 401 may be located in the through hole 340 so that the bottom wall is flush with a surface of the magnetic conductive plate 34 toward the diaphragm 21. The bottom wall of the first groove 401 may not be located in the through hole 340, so that the bottom wall protrudes from the surface of the magnetic conductive plate 34 toward the diaphragm 21. It should also be noted that the adaptation of the through hole 340 and the first groove 401 means that the shape of the through hole 340 is the same as the shape of the first groove 401, and the size of the through hole 340 is larger than the size of the first groove 401, so that the side wall and the bottom wall of the first groove 401 can be located in the through hole 340.

In the present disclosure, the first main magnet 32 and the auxiliary magnet 33 are located at the first central portion 341 of the magnetic conductive plate 34. The first edge portion 342 is provided with a through hole 340. The first edge portion 342 of the magnetic conductive plate 34 is opposite to the second edge portions 42 of the screen cloth 40. The second edge portion 42 of the screen cloth 40 is provided with a first groove 401 recessed toward the magnetic conductive plate 34, corresponding to the through hole 340. When the speaker device 100 is mounted in a speaker box, the first groove 401 can be used to fill a sound absorbing material, so that the space for filling the sound absorbing material in the speaker device 100 and an equivalent volume of a rear chamber of the speaker device 100 is increased, thereby improving the acoustic effect of the speaker device 100.

Figure 4:
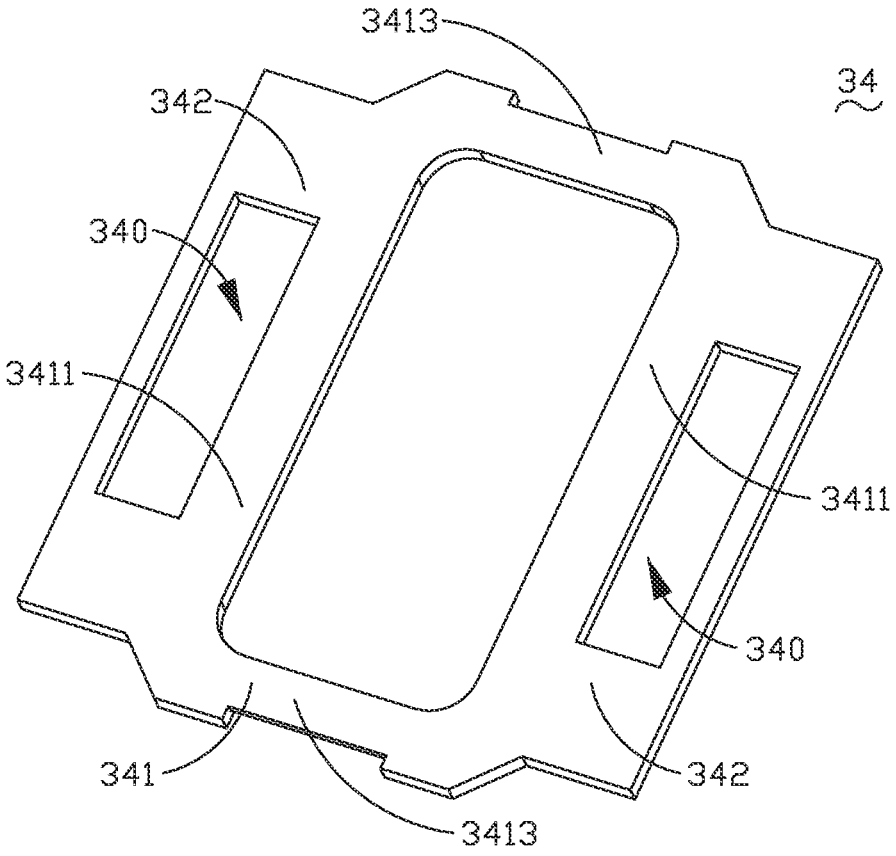
FIG. 4 is a schematic diagram illustrating a structure of a magnetic conductive plate of the speaker device shown in FIG. 1 according to an embodiment of the present disclosure.

Referring to FIG. 2, FIG. 3 and FIG. 4, FIG. 4 is a view illustrating a structure of the magnetic conductive plate of the speaker device shown in FIG. 1. The first central portion 341 is provided with two first edges 3411 and two third edges 3413. The two first edges 3411 are opposite to each other, and the two third edges 3413 are opposite to each other. The two third edges 3413 are connected to two ends of the two first edges 3411 respectively. The first edge portion 342 is connected to the first edge 3411 of the first central portion 341.

The vibration unit 20 may further include a voice diaphragm 23 and a flexible printed circuit (FPC) 24. The FPC 24 is adjacent to the third edge 3413. The voice diaphragm 23 and the FPC 24 are stacked along the vibrating direction of the diaphragm 21. The voice diaphragm 23 protrudes toward the screen cloth 40.

Figure 5:
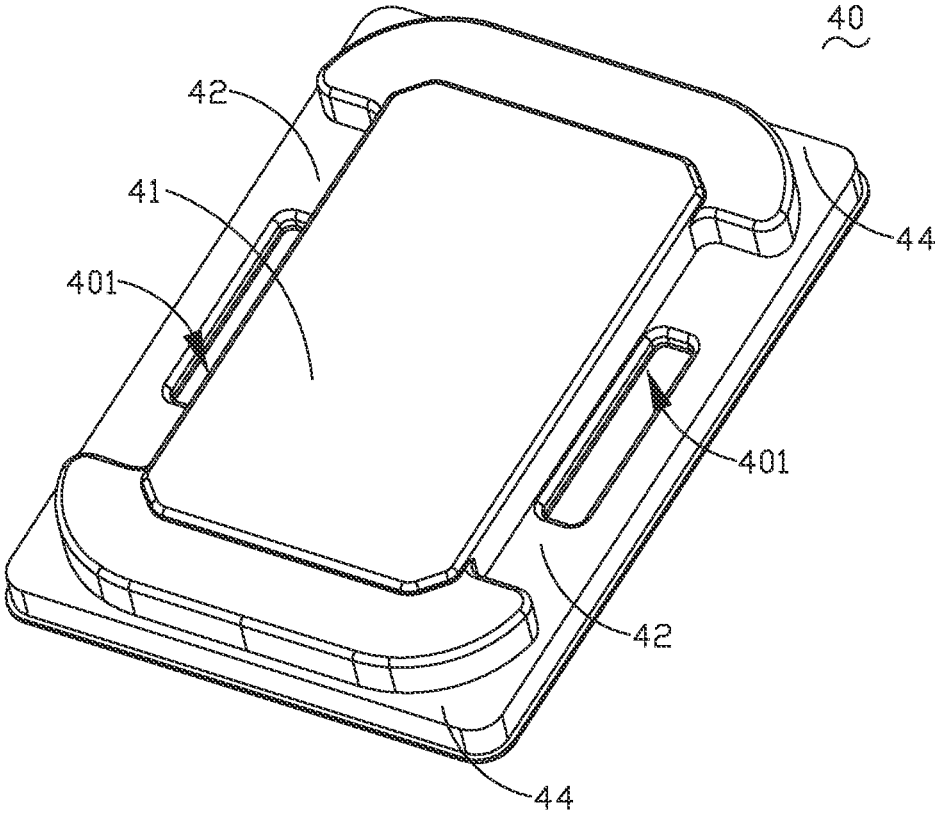
FIG. 5 is a schematic diagram illustrating a structure of a screen cloth of the speaker device shown in FIG. 1 according to an embodiment of the present disclosure.
Figure 6:
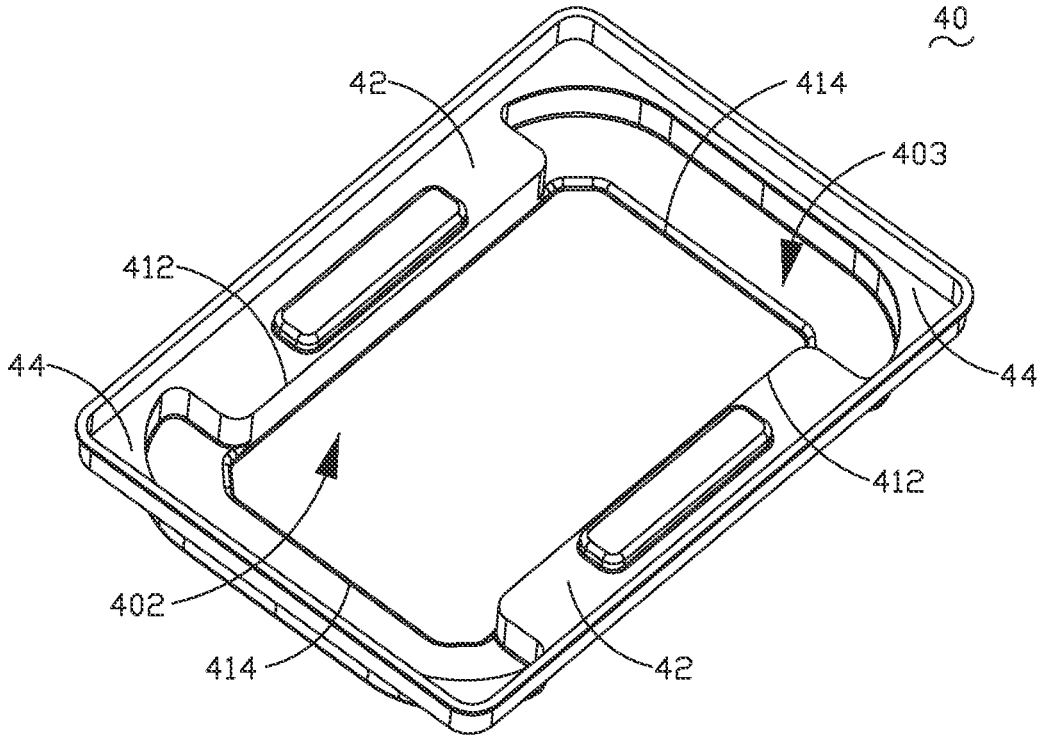
FIG. 6 is a schematic diagram illustrating a structure of the screen cloth of the speaker device shown in FIG. 1 according to another embodiment of the present disclosure.

Referring to FIG. 5 and FIG. 6, FIG. 5 is a first view illustrating a structure of the screen cloth of the speaker device shown in FIG. 1, and FIG. 6 is a second view illustrating the structure of the screen cloth of the speaker device shown in FIG. 1. The second central portion 41 has two second edges 412 and two fourth edges 414. The two second edges 412 are opposite to each other, and the two fourth edges 414 are opposite to each other. The two fourth edges 414 are connected to two ends of the two second edges 412, respectively. The second edge portion 42 is connected to the second edge 412 of the second central portion 41.

The second central portion 41 is provided with a second groove 402. An opening of the second groove 402 opens toward the diaphragm 21. The second groove 402 is used to accommodate the carrier 31, the first main magnet 32 and the auxiliary magnet 33 of the magnetic circuit unit 30.

The screen cloth 40 further includes a fourth edge portion 44. The fourth edge portion 44 is connected to the fourth edge 414 of the second central portion 41. The fourth edge portion 44 is provided with a third groove 403, and an opening of the third groove 403 opens toward the diaphragm 21. The third groove 403 is used to avoid the voice diaphragm 23.

Figure 7:
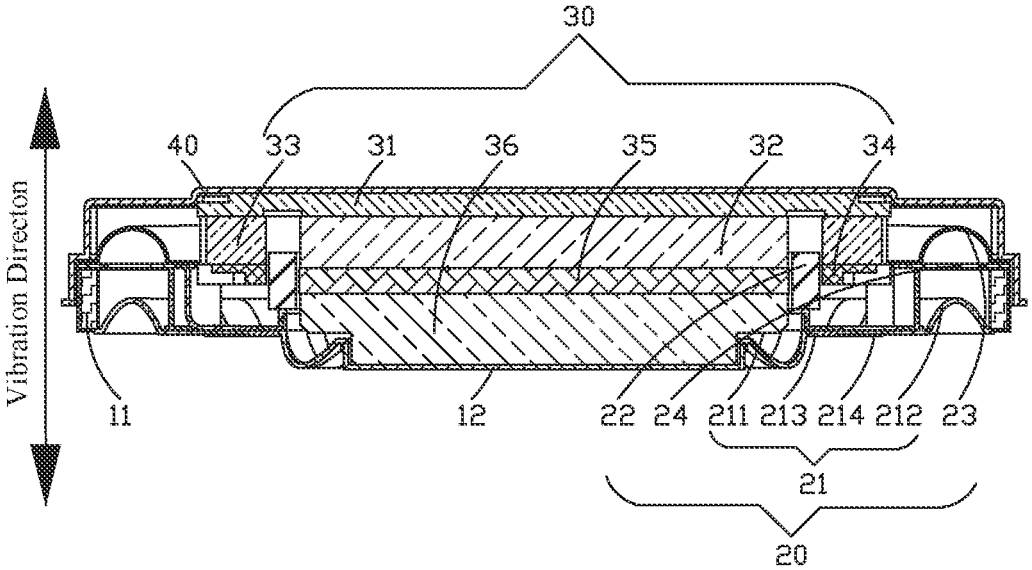
FIG. 7 is a cross-sectional view of the speaker device shown in FIG. 1 along line P2-P2 according to an embodiment of the present disclosure.

Referring to FIG. 2, FIG. 3 and FIG. 7, FIG. 7 is a cross-sectional view of the speaker device shown in FIG. 1 along line P2-P2. The diaphragm 21 may include a first diaphragm 211, a second diaphragm 212, a dome 213 and a holder 214. The first diaphragm 211, the second diaphragm 212 and the dome 213 are respectively provided on the holder 214. The holder 214 is located at a side of the diaphragm 21 toward the voice coil 22. The voice coil 22 is inserted into the magnetic gap of the magnetic circuit unit 30 through the holder 214.

The first diaphragm 211 is a ring structure. The first diaphragm 211 has an inner edge and an outer edge. The outer edge of the first diaphragm 211 is fixed to the frame 11. The first diaphragm 211 protrudes toward the screen cloth 40. That is, the first diaphragm 211 protrudes in the same direction as the voice diaphragms 23. One part of a protruding area of the first diaphragm 21 is arranged opposite to a protruding area of the voice diaphragm 23 along the vibrating direction of the diaphragm 21, and the other part of the protruding area of the first diaphragm 211 is arranged opposite to the through hole 340 of the magnetic conductive plate 34 along the vibrating direction of the diaphragm 21.

The second diaphragm 212 also is a ring structure. The shape of the second diaphragm 212 is the same as the shape of the first diaphragm 211, but the size of the second diaphragm 212 is smaller than the size of the first diaphragm 211. The second diaphragm 212 has an inner edge and an outer edge. The outer edge of the second diaphragm 212 is connected to the inner edge of the first diaphragm 211 through the dome 213. The second diaphragm 212 protrudes facing away from the screen cloth 40. That is, the protruding direction of the second diaphragm 212 is opposite to the protruding directions of the first diaphragm 211 and the voice diaphragms 23.

Referring to FIG. 3 and FIG. 7, the magnetic circuit unit 30 may further include a pole plate 35 and a second main magnet 36. The second main magnet 36 and the first main magnet 32 are stacked along the vibrating direction of the diaphragm 21. The pole plate 35 is provided between the first main magnet 32 and the second main magnet 36. The speaker device 100 may further include a cover 12. The cover 12 is provided on the second main magnet 36. An inner edge of the second diaphragm 212 is connected to an edge of the cover 12.

The above described are merely embodiments of the present disclosure. It should be noted here that those skilled in the art may make improvements without departing from the concept of the present disclosure, but such improvements should fall within the protection scope of the present disclosure.

What is claimed is:

1. A speaker device, comprising:

a frame;

a vibration unit fixedly connected to the frame;

a magnetic circuit unit having a magnetic gap; and a screen cloth, wherein the vibration unit comprises a diaphragm fixed to the frame, and a voice coil inserted in the magnetic gap; the magnetic circuit unit comprises a carrier, a first main magnet provided at a side of the carrier toward the diaphragm, an auxiliary magnet provided on a periphery of the first main magnet and defining the magnetic gap with the first main magnet, and a magnetic conductive plate provided at a side of the auxiliary magnet toward the diaphragm; and the magnetic conductive plate is fixed to the frame; and the magnetic conductive plate comprises a first central portion and a first edge portion that abuts to an edge of the first central portion; the auxiliary magnet is located at the first central portion; the first edge portion is provided with a through hole; the screen cloth is provided at a side of the carrier away from the diaphragm and comprises a second central portion and a second edge portion that abuts to an edge of the second central portion; the second edge portion is arranged opposite to the first edge portion along a vibrating direction of the diaphragm; and the second edge portion is provided with a first groove recessed toward the magnetic conductive plate, corresponding to the through hole.

2. The speaker device as described in claim 1, wherein the first groove is formed by enclosing a side wall and a bottom wall; the side wall is at least partially located in the through hole, and the bottom wall is located in the through hole; and the bottom wall is flush with a surface of the magnetic conductive plate toward the diaphragm.

3. The speaker device as described in claim 1, wherein the second central portion is provided with a second groove opening toward the diaphragm; and the second groove is configured to accommodate the carrier, the first main magnet and the auxiliary magnet.

4. The speaker device as described in claim 1, wherein the first central portion comprises two first edges opposite to each other, and two third edges connected to two ends of each of the two first edges respectively; and the first edge portion is connected to the first edge; and the vibration unit further comprises a voice diaphragm; the voice diaphragm abuts to the two third edges; and the voice diaphragm protrudes toward the screen cloth.

5. The speaker device as described in claim 4, wherein the second central portion comprises two second edges opposite to each other, and two fourth edges that are connected to two ends of each of the two second edges, respectively; and the second edge portion is connected to the second edge; and the screen cloth further comprises a fourth edge portion connected to the fourth edge; the fourth edge portion is provided with a third groove opening toward the diaphragm; and the third groove is configured to avoid the voice diaphragm.

6. The speaker device as described in claim 1, wherein the diaphragm comprises a first diaphragm and a second diaphragm, each of the first diaphragm and the second diaphragm has a ring shape; an outer edge of the first diaphragm is fixed to the frame; an inner edge of the first diaphragm is connected to an outer edge of the second diaphragm; the first diaphragm protrudes toward the screen cloth; and the second diaphragm protrudes facing away from the screen cloth.

7. The speaker device as described in claim 6, wherein the magnetic circuit unit further comprises a second main magnet and a pole plate; the second main magnet and the first main magnet are stacked along the vibrating direction of the diaphragm; and the pole plate is provided between the first main magnet and the second main magnet; and the speaker device further comprises a cover; the cover covers the second main magnet; and an inner edge of the second diaphragm is connected to an edge of the cover.

8. The speaker device as described in claim 6, wherein the diaphragm further comprises a dome; and the dome is connected between the inner edge of the first diaphragm and the outer edge of the second diaphragm.

9. The speaker device as described in claim 8, wherein the diaphragm further comprises a holder; the holder is provided at a side of the first diaphragm and the second diaphragm toward the voice coil; each of the first diaphragm, the second diaphragm and the dome is provided on the holder; and the voice coil is inserted in the magnetic gap through the holder.

10. The speaker device as described in claim 1, wherein the screen cloth is a mesh cloth.

* * * * *